US007828510B2

(12) United States Patent
Chang et al.

(10) Patent No.: US 7,828,510 B2
(45) Date of Patent: Nov. 9, 2010

(54) FAN

(75) Inventors: Shun-Chen Chang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 479 days.

(21) Appl. No.: 11/262,850

(22) Filed: Nov. 1, 2005

(65) Prior Publication Data

US 2006/0275116 A1 Dec. 7, 2006

(30) Foreign Application Priority Data

Jun. 2, 2005 (TW) ..... 94118154 A

(51) Int. Cl.
*F04D 29/44* (2006.01)
*F04D 29/54* (2006.01)

(52) U.S. Cl. ..... 415/61; 415/62; 415/68; 415/199.1; 415/199.2; 415/199.6; 416/175; 416/201 A

(58) Field of Classification Search ..... 415/61, 415/62, 68, 69, 198.1, 199.1–199.6; 416/175, 416/183, 203, 201 A
See application file for complete search history.

(56) References Cited

U.S. PATENT DOCUMENTS 965,025 A * 7/1910 Serrell ..... 415/199.1
982,393 A * 1/1911 Spencer ..... 415/199.2
2,121,073 A * 6/1938 De Bothezat ..... 415/69
2,604,501 A * 7/1952 Wightman ..... 415/199.2
2,782,982 A * 2/1957 Merz ..... 415/199.5
3,083,893 A * 4/1963 Dean ..... 415/68
3,153,383 A * 10/1964 Pilarczyk ..... 415/199.2
3,250,458 A * 5/1966 Caldwell ..... 415/199.2
5,839,205 A * 11/1998 Hung ..... 34/97
6,612,817 B2 * 9/2003 Lin et al. ..... 415/199.5
6,904,960 B1 * 6/2005 Su et al. ..... 415/209.1
7,134,839 B2 * 11/2006 Horng et al. ..... 415/199.4

* cited by examiner

*Primary Examiner*—Christopher Verdier
(74) *Attorney, Agent, or Firm*—Birch, Stewart, Kolasch & Birch, LLP

(57) ABSTRACT

This is related to a fan including a casing, a first impeller structure, a second impeller structure, and at least one driving device. The casing has an outlet and an air-containing portion having an entrance and an exit provided inside the casing. The first impeller structure and the second impeller structure are installed inside the casing, and include a first blade set and a second blade set, respectively. The first blade set is located corresponding to the entrance of the air-containing portion. The second blade set is located corresponding to the exit of the air-containing portion. The driving device drives the first and second impeller structures.

20 Claims, 6 Drawing Sheets

2

FAN

BACKGROUND OF THE INVENTION

1. Field of Invention

The invention relates to a fan and, in particular, to a centrifugal fan.

2. Related Art

In the conventional electrical system, the electrical component, such as a CPU, is usually provided. The electrical component generates heat and may have lower performance at the high temperature. In such a case, to maintain the acceptable performance of the electrical component, the generated heat must be removed as soon as fast. To achieve this objective, a blower is usually adopted to dissipate heat quickly.

In the present, there are two most popular fans including the axial fan and the centrifugal fan (or the blower). Since the centrifugal fan provides airflow with higher pressure, it can achieve better heat dissipating effect. Thus, the centrifugal fan has become the major trend. As shown in FIG. 1, the conventional centrifugal fan 1 includes a casing 11, an impeller structure 13 and a driving device 15. The casing 11 has an axial inlet and an outlet 111, and the impeller structure 13 and driving device 15 are installed inside the casing 11. The blade set 131 of the impeller structure 13 is located corresponding to the outlet 111. In this case, when the driving device 15 drives the impeller structure 13 to rotate, the blade set 131 presses the air to generate the airflow through the outlet 111.

However, the centrifugal fan 1 can only provide a one stage compressing, so the pressure increasing effect of the centrifugal fan 1 is limited.

It is therefore an important subject of the invention to provide a centrifugal fan that can enhance the pressure increasing effect.

SUMMARY OF THE INVENTION

In view of the foregoing, the invention is to provide a centrifugal fan that can efficiently enhance the pressure increasing effect.

To achieve the above, a centrifugal fan of an embodiment of the invention includes a casing, a first impeller structure, a second impeller structure, and at least one driving device. In the embodiment of the invention, the casing has an outlet and at least one first air-containing portion, which has a first lateral entrance and a first exit, provided inside the casing. The first impeller structure and the second impeller structure are installed inside the casing, and include a first blade set and a second blade set, respectively. The first blade set is located corresponding to the first lateral entrance of the air-containing portion. The second blade set is located corresponding to the first exit of the air-containing portion. The driving device drives one of the first and second impeller structures.

As mentioned above, the casing of the centrifugal fan of the invention has the air-containing portion for enhancing the pressure increasing effect. As a result, the heat dissipating ability of the centrifugal fan of the invention can be improved.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
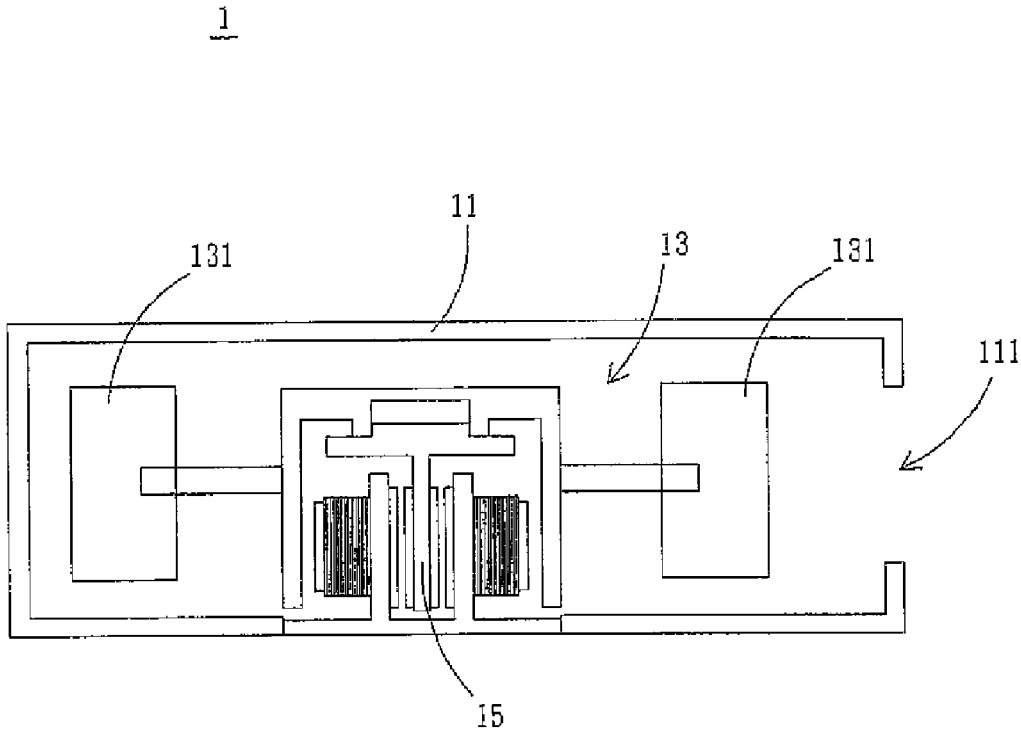
PRIOR ART FIG. 1
FIG. 1 is a schematic view showing the conventional centrifugal fan.
Figure 2:
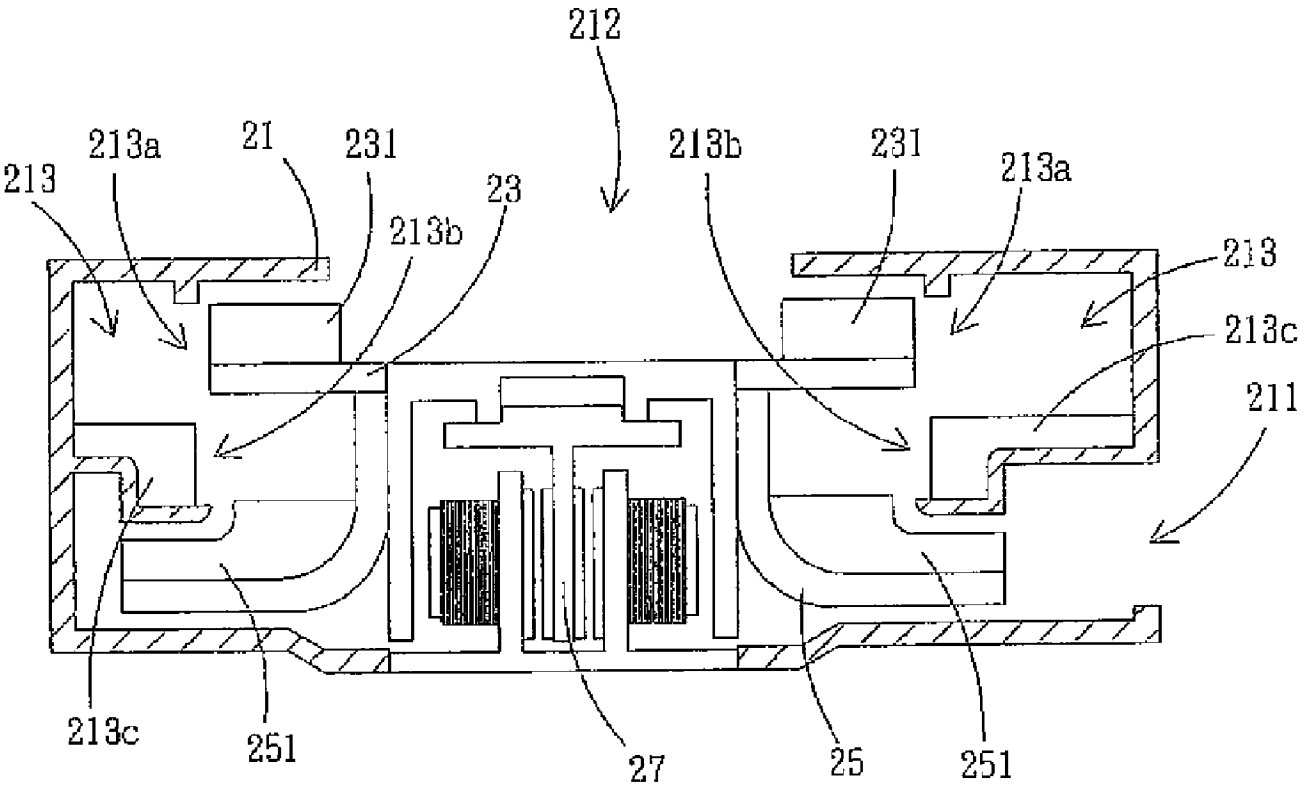
FIG. 2 is a schematic view showing a centrifugal fan according to a first preferred embodiment of the invention.

With reference to FIG. 2, a centrifugal fan 2 according to a first preferred embodiment of the invention includes a casing 21, an first impeller structure 23, an second impeller structure 25, and at least one first driving device 27.

The casing 21 has an outlet 211 and an axial inlet 212. A first air-containing portion 213, which has a first lateral entrance 213*a* and a first exit 213*b*, is disposed inside the casing 21. In this embodiment, the first air-containing portion 213 is an annular space located at the upper of the interior of the casing 21. The first air-containing portion 213 is used for temporarily storing the air so as to provide the air accumulating function.

Figure 3:
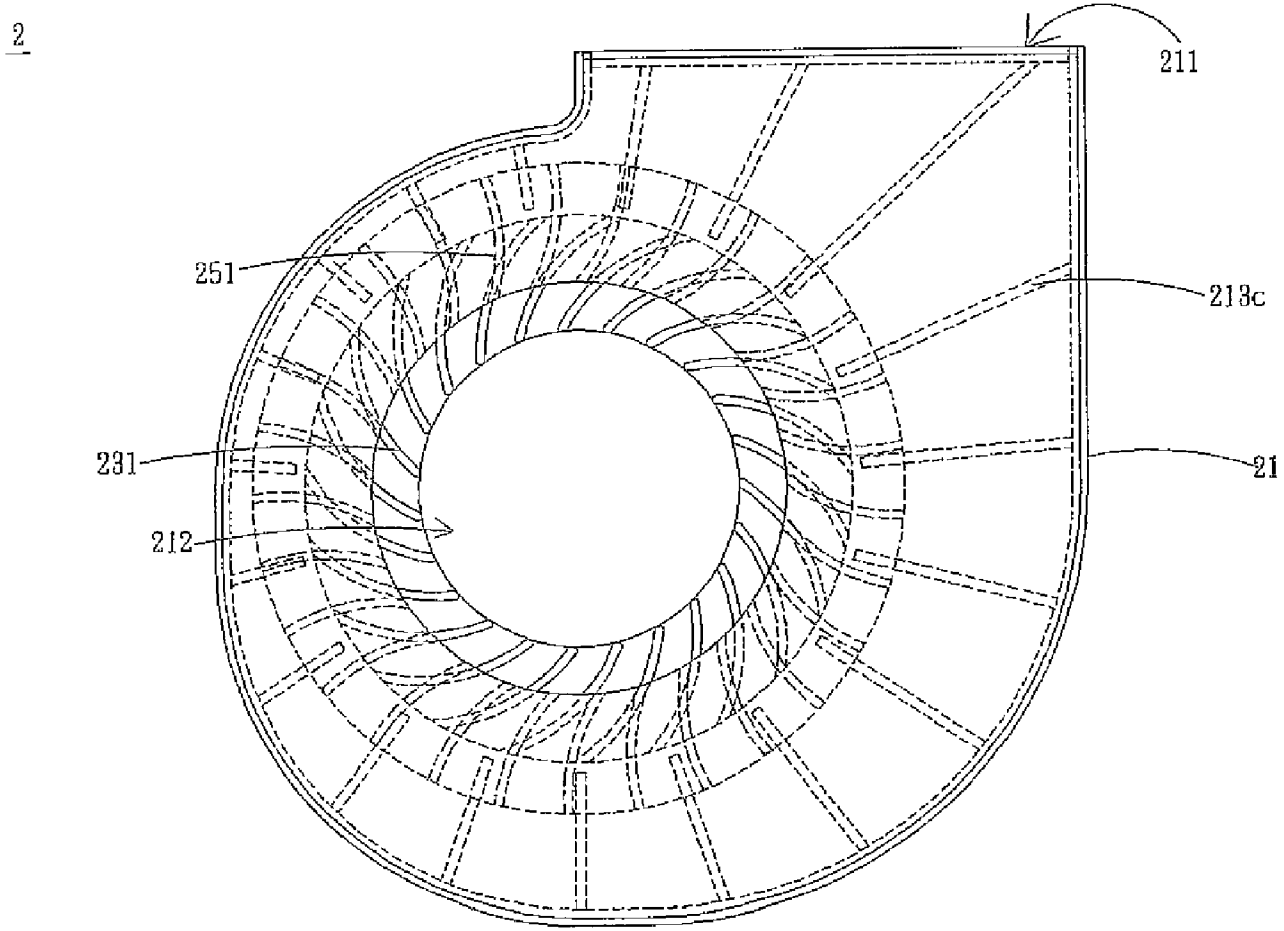
FIG. 3 is a schematic view showing a centrifugal fan according to a second preferred embodiment of the invention.

Furthermore, the first air-containing portion 213 has at least one first vortex offsetting element 213*c* located at the position that the vortex may occur inside the first air-containing portion 213. For example, the vortex may appear at the corner or the first exit 213*b* inside the first air-containing portion 213. In this case, the first vortex offsetting element 213*c* can eliminate the vortex caused by the air flowing through the first air-containing portion 213. Since the vortex may reduce the air accumulating function of the first air-containing portion 213, the configuration of the first vortex offsetting element 213*c* for eliminating the vortex can maintain the air accumulating function of the first air-containing portion 213. The first vortex offsetting element 213*c* is a rib (as shown in FIG. 3), a plate structure, or a curved structure. Besides, there can be a plurality of first vortex offsetting elements 213*c* disposed inside the first air-containing portion 213 for further enhancing the effect of eliminating the vortex.

As shown in FIG. 2, the first impeller structure 23 is disposed in the casing 21 and has a first blade set 231, which is located corresponding to the first entrance 213*a* of the first air-containing portion 213. In addition, the second impeller structure 25 is also disposed in the casing 21 and has a second blade set 251, which is located corresponding to the first exit 213*b* of the first air-containing portion 213 and the outlet 211 of the casing 21. In the present embodiment, the first vortex offsetting element 213*c* and the second blade set 251 are horizontally interlaced disposed, the first vortex offsetting element 213*c* is extended above the second blade set 251 so that they are overlapped along an axial line of the fan 2, and the first vortex offsetting element 213*c* and the first blade set 231 are entirely non-overlapped with each other along the axial line of the fan 2. In the current embodiment, the first impeller structure 23 and the second impeller structure 25 are serially arranged and are both either centrifugal impellers or axial-flow impellers. The diameter of the second impeller structure 25 is greater than that of the first impeller structure 23. The blades of the first blade sets 231 and the blades of the second blade sets 251 are rectangular, polygonal, L-shaped, or the like, and the blades may have any preferred shape with curved corners. Moreover, to enhance the airflow pressing effect of the second impeller structure 25, the second blade set 251 of the second impeller structure 25 is preferably L-shaped. Besides, the blades of the first blade sets 231 and the blades of the second blade sets 251 may have curved corners, and the extension directions from the ends of the first blade sets 231 and the blades of the second blade sets 251 are perpendicular to the axial direction of the first blade sets 231 and the blades of the second blade sets 251.

Figure 4:
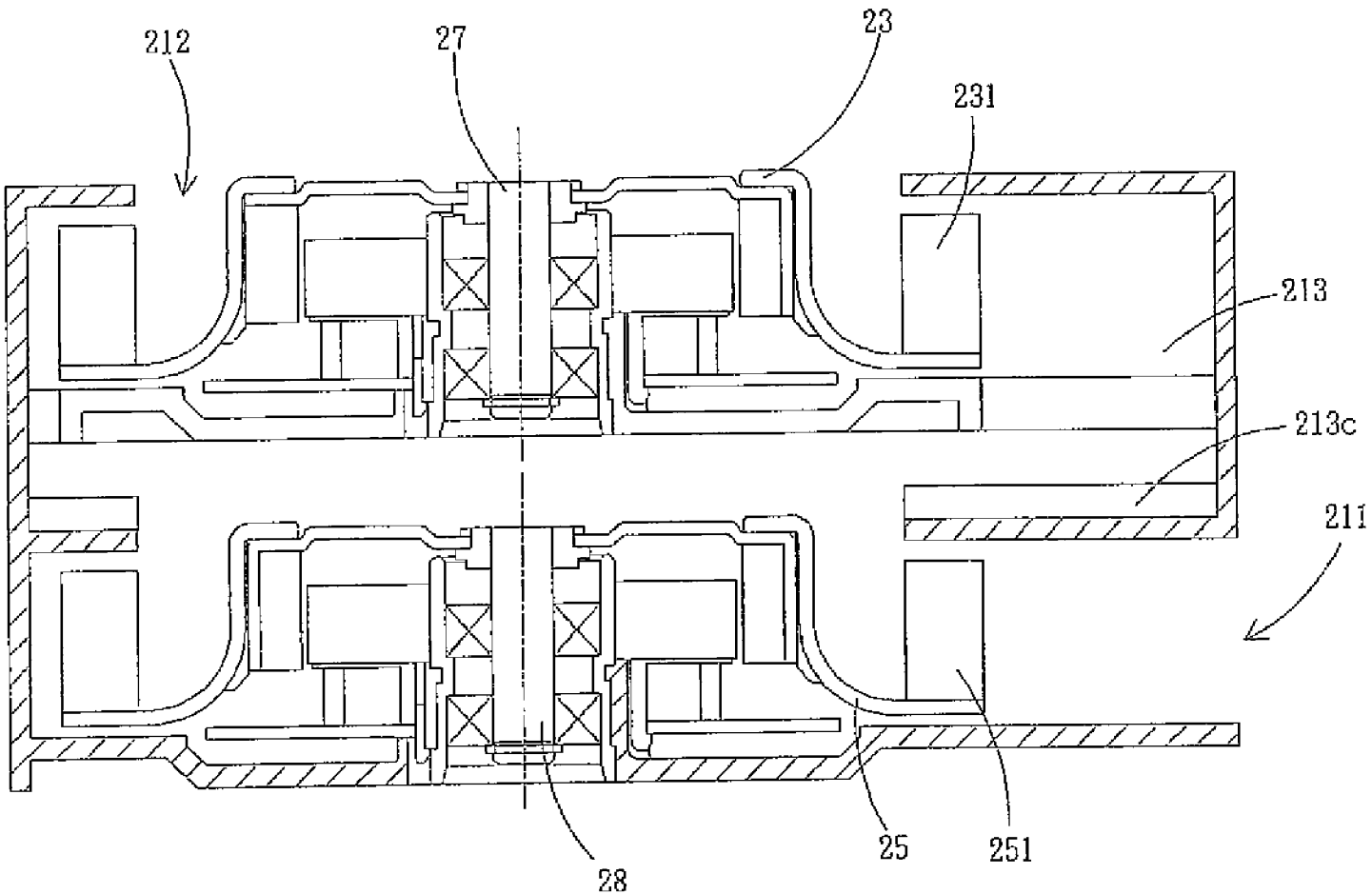
FIG. 4 is a schematic view showing a centrifugal fan according to a third preferred embodiment of the invention.

The first driving device 27 is disposed in the casing 21 and drives the first impeller structures 23 and the second impeller structure 25. In the embodiment, the first impeller structure 23 and the second impeller structure 25 are pivoted to the first driving device 27, respectively. Accordingly, the first driving device 27 is disposed inside the first impeller structure 23 or the second impeller structure 25 and can simultaneously drive the first impeller structure 23 and the second impeller structure 25. Alternatively, the first driving device 27 may only drive one of the first impeller structure 23 and the second impeller structure 25. Then, the other one of the first impeller structure 23 and the second impeller structure 25 that is not driven by the first driving device 27 is driven by the one driven by the first driving device 27. In addition, the first driving device 27 and a second driving device 28 (as shown in FIG. 4) may be used to drive the first impeller structure 23 and the second impeller structure 25, respectively.

In this embodiment, when the first driving device 27 drives the first impeller structure 23 to rotate, the first impeller structure 23 sucks the air from the inlet 212 and then blows the air into the first air-containing portion 213 through the first entrance 213*a*. After that, the air flows from the first air-containing portion 213 to the second blade set 251, and the second blade set 251 blows the air out through the outlet 211. As mention above, the first vortex offsetting element(s) 213*c* disposed inside the first air-containing portion 213 may properly eliminate the vortex. In this case, since the first impeller structure 23 presses the air, the air flowing toward the second blade set 251 from the first exit 213*b* of the first air-containing portion 213 has a pressure greater than the external pressure such as the pressure at the inlet 212. When the second impeller structure 25 presses the air from the first exit 213*b* of the first air-containing portion 213 and blows the air out through the outlet 211, the air through the outlet 211 can be further pressed so as to obtain the air of higher pressure.

To be noted, the centrifugal fan of the invention is not limited to the above-mentioned embodiment. For example, the first impeller structure can be an axial-flow impeller structure (not shown) and the second impeller structure is a centrifugal impeller structure. Besides, the centrifugal fan of the invention may include a plurality of driving devices (not shown) for driving different impeller structures such as the previously mentioned first impeller structure 23 and the second impeller structure 25.

Furthermore, the centrifugal fan of the invention may include a plurality of impeller structures and a plurality of air-containing portions, such as three impeller structures and two air-containing portions, four impeller structures and three air-containing portions, or five impeller structures and four air-containing portions. Moreover, multiple impeller structures may correspond to the same air-containing portion, so that the centrifugal fan of the invention may include five impeller structures and two air-containing portions. To make the invention more comprehensive, an example of the centrifugal fan having three impeller structures and two air-containing portions is described hereinafter.

Figure 5:
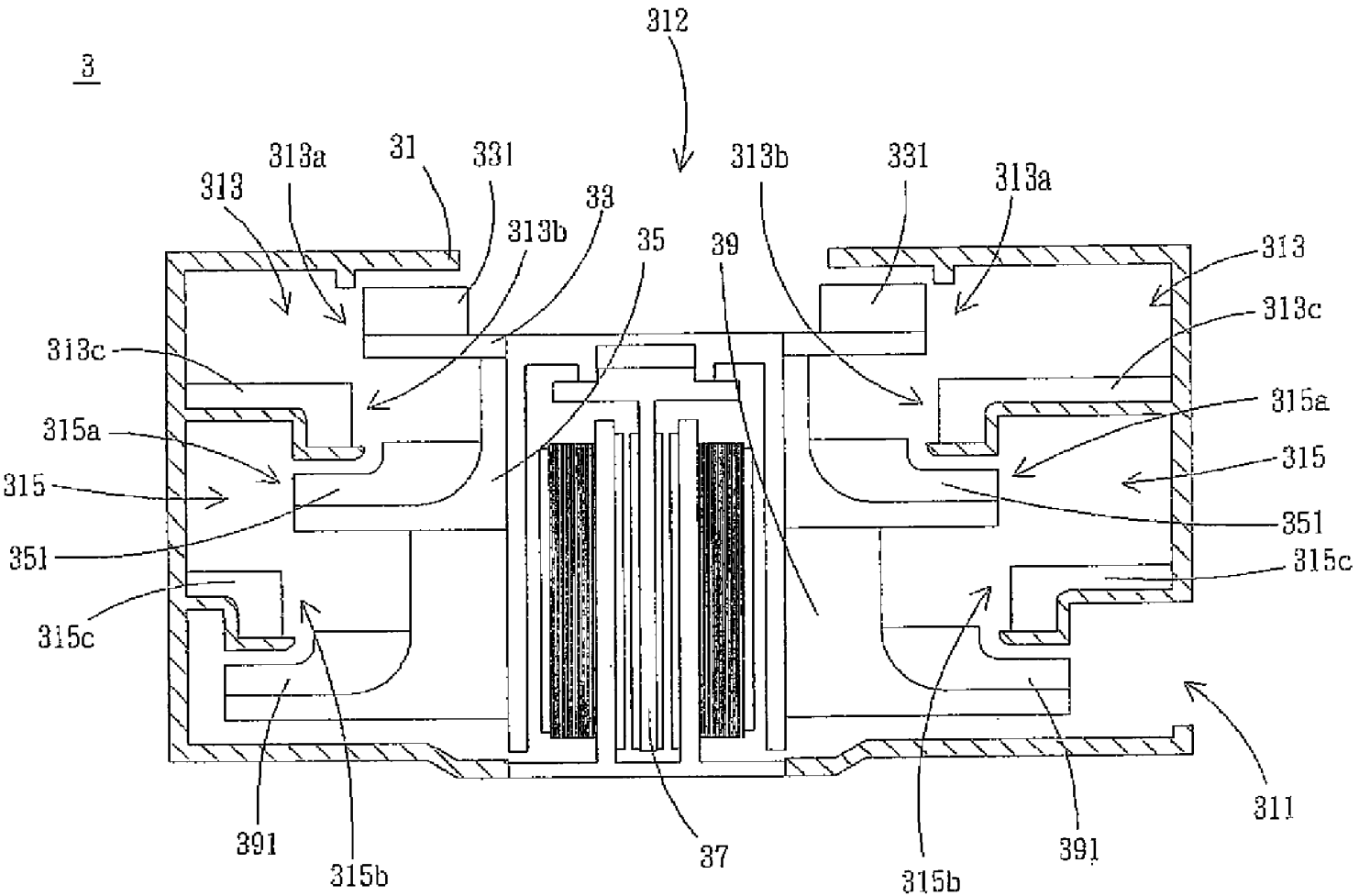
FIG. 5 is a schematic view showing a centrifugal fan according to a fourth preferred embodiment of the invention.
Figure 6:
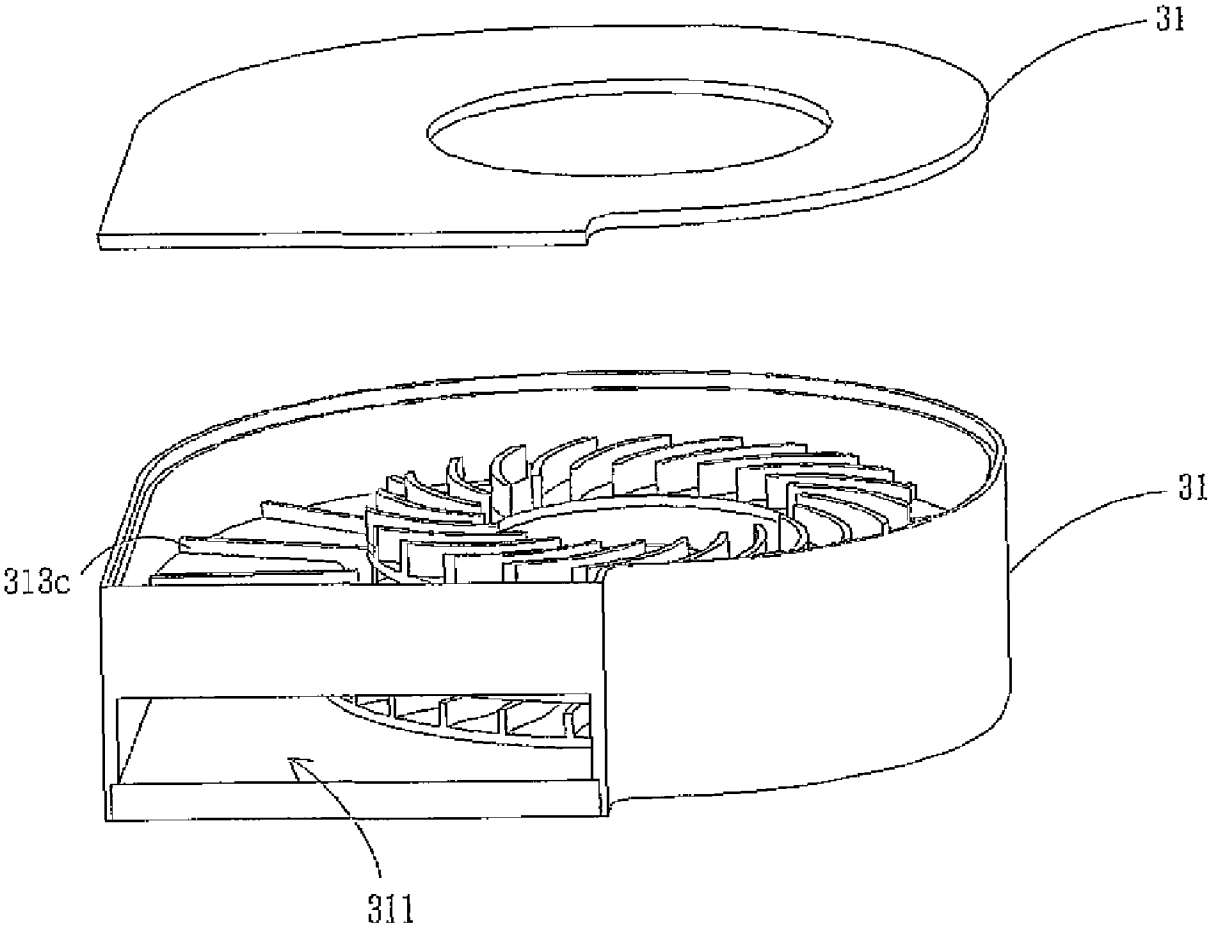
FIG. 6 is a schematic view showing a centrifugal fan according to a fifth preferred embodiment of the invention.

With reference to FIGS. 5 and 6, a centrifugal fan 3 according to fourth preferred embodiment of the invention includes a casing 31, at least one first impeller structure 33 which can be a centrifugal impeller structure, a second impeller structure 35, a third structure 39, and at least one first driving device 37. Comparing the present embodiment and the previous embodiment, the centrifugal fan 3 of the present embodiment has more air-containing portions for enhancing the air pressure at the outlet by multiple compressing. In this embodiment, the only concern for the dimensions of the impeller structures is that the third impeller structure 39 must have greater diameter than that of the second impeller structure 35. Herein, the blades of the third blade set 391 of the second impeller structure 39 are rectangular, polygonal, or L-shaped, and the blades of the first blade set 331 of the first impeller structure 33 and the blades of the second blade set 351 of the second impeller structure 35 can also be rectangular, polygonal, or L-shaped. The blades may have any preferred shape with curved corners.

The operation of the centrifugal fan 3 of this embodiment will be described hereinafter. In this embodiment, the casing 31 has a lateral outlet 311 and an axial inlet 312. At least one first air-containing portion 313, which has a first lateral entrance 313*a*, a first exit 313*b* and at least one first vortex offsetting element 313*c*, and an second air-containing portion 315, which has an second entrance 315*a*, an second exit 315*b* and a second vortex offsetting element 315*c*, are disposed inside the casing 31. In addition, the first vortex offsetting element 313*c* is for eliminating a vortex caused by air flowing through the first air-containing portion 313, and the first vortex offsetting element 313*c* is a rib (as shown in FIG. 6), a plate structure, or a curved structure. The first vortex offsetting element 313*c* is located at a corner of the first air-containing portion 313 or the first exit 313*b* of the first air-containing portion 313. In this embodiment, a length between the inner side of the first vortex offsetting element 313*c* and the outer side of the first vortex offsetting element 313*c* is different from a length between the inner side of the second vortex offsetting element 315*c* and the outer side of the second vortex offsetting element 315*c* (shown in FIG. 5). The first vortex offsetting element 313*c* and the second blade set 351 are horizontally interlaced disposed. The second vortex offsetting element 315*c* and the third blade set 391 are horizontally interlaced disposed. In this case, the second vortex offsetting element 315*c* is disposed between the second impeller structure 35 and the third impeller structure 39, and the second vortex offsetting element 315*c* is extended above the third blade set 391 so that they are overlapped along axial line of the fan 3. The first vortex offsetting element 313*c* is disposed between the second impeller structure 35 and the first impeller structure 33, the first vortex offsetting element 313*c* is extended above the second blade set 351 so that they are overlapped along the axial line of the fan 3, and the first vortex offsetting element 313*c* and the first blade set 331 are entirely non-overlapped with each other along the axial line of the fan. The first air-containing portions 313 and the second air-containing portion 315 are two stacked annular spaces located at the upper of the interior of the casing 31. The first air-containing portion 313 and the second air-containing portion 315 are used for temporarily storing the air so as to provide the multi-step air accumulating function.

The first impeller structure 33, the second impeller structure 35 and the third impeller structure 39 are disposed in the casing 31 and have the first blade sets 331, the second blade set 351 and the third blade set 391, respectively. In this case, the first blade set 331 is located corresponding to the first entrance 313*a* of the first air-containing portion 313. The second blade set 351 is located corresponding to the first exit 313*b* of the first air-containing portion 313 and the second entrance 315*a* of the second air-containing portion 315. The third blade set 391 is located corresponding to the second exit 315*b* of the second air-containing portion 315 and the outlet 311 of the casing 31. In the current embodiment, the first impeller structure 33, the second impeller structure 35 and the third impeller structure 39 are serially arranged.

In the present embodiment, the first impeller structure 33, the second impeller structure 35 and the third impeller structure 39 are simultaneously driven by the first driving device 37. Of course, the first driving device 37 may only drive one of the first impeller structure 33, the second impeller structure 35 and the third impeller structure 39, and the driven impeller structure is used to drive the residual impeller structures. When the first impeller structure 33, the second impeller structure 35 and the third impeller structure 39 rotate, the first impeller structure 33 sucks the air from the inlet 312 and then blows the air into the first air-containing portion 313 through the first lateral entrance 313*a*. After that, the second impeller structure 35 sucks the air from the first exit 313*b* of the first air-containing portion 313 and then blows the air into the second air-containing portion 315 through the second lateral entrance 315*a*. Finally, the third impeller structure 39 sucks the air from the second exit 315*b* of the second air-containing portion 315 and then blows the air out through the outlet 311. In this case, the pressure in the second air-containing portion 315 is greater than that in the first air-containing portion 313, and the pressure in the first air-containing portion 313 is greater than the external pressure such as the pressure at the inlet 312. Thus, the first impeller structure 33, the second impeller structure 35 and the third impeller structure 39 can a provide multi-step pressing effect, which can emphasize the pressing effect.

In summary, the casing of the centrifugal fan of the invention has the air-containing portion, such as the first air-containing portion 213, the first air-containing portion 313 or the second air-containing portion 315, for enhancing the pressure increasing effect. Moreover, the invention can provide the multi-step pressing effect. As a result, the heat dissipating ability of the centrifugal fan of the invention can be improved.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A fan, comprising:

a casing having a first air-containing portion disposed therein, wherein the air-containing portion comprises a first entrance and a first exit, and the first air-containing portion comprises a first vortex offsetting element for eliminating a vortex caused by air flowing through the first air-containing portion;

a first impeller structure installed inside the casing and comprising a first blade set, wherein the first blade set is located corresponding to the first entrance of the first air-containing portion; and a second impeller structure installed inside the casing and comprising a second blade set, wherein the second blade set is located corresponding to the first exit of the first air-containing portion, a diameter of the second impeller structure is greater than that of the first impeller structure, the second blade set and the first vortex offsetting element are interlaced disposed, and the first vortex offsetting element is extended above a part of the second blade set so that the first vortex offsetting element and the second blade set are overlapped along an axial line of the fan, and the first vortex offsetting element and the first blade set are entirely non-overlapped with each other along the axial line of the fan.

2. The fan of claim 1, wherein the first vortex offsetting element is a rib, a plate structure, or a curved structure.

3. The fan of claim 1, wherein the first vortex offsetting element is located at a corner of the first air-containing portion or the first exit of the first air-containing portion.

4. The fan of claim 1, further comprising at least one first driving device for driving one of the first impeller structure and the second impeller structure.

5. The fan of claim 4, wherein the first driving device is disposed inside the first impeller structure and simultaneously drives the first impeller structure and the second impeller structure.

6. The fan of claim 4, further comprising: a second driving device, wherein the first driving device and the second driving device respectively drive the first impeller structure and the second impeller structure.

7. The fan of claim 4, wherein the first driving device drives one of the first impeller structure and the second impeller structure; and the other one of the first impeller structure and the second impeller structure that is not driven by the first driving device is driven by the first impeller structure or the second impeller structure, which is driven by the first driving device.

8. The fan of claim 1, wherein the first impeller structure and the second impeller structure are centrifugal impellers.

9. The fan of claim 1, wherein the first impeller structure and the second impeller structure are serially arranged.

10. The fan of claim 1, wherein the blades of the first blade set or the second blade set are rectangular and the blades of the second blade set have a shape with curved corners.

11. The fan of claim 1, wherein an extension direction from the end of the first blade set or the second blade set is perpendicular to the axial direction of the first blade set or the second blade set.

12. The fan of claim 1, further comprising:

a second air-containing portion disposed in the casing and having a second entrance and a second exit; and a third impeller structure disposed below the second impeller and comprising a third blade set, wherein the second blade set is located corresponding to the first exit of the first air-containing portion and the second entrance of the second air-containing portion; the third blade set is located corresponding to the second exit of the second air-containing portion and the outlet of the casing.

13. The fan of claim 12, wherein the first air-containing portion has a pressure greater than an external pressure, and the second air-containing portion has a pressure greater than that of the first air-containing portion.

14. The fan of claim 12, wherein the third impeller structure is a centrifugal impeller structure.

15. The fan of claim 12, wherein the blades of the third blade set are rectangular.

16. The fan of claim 12, wherein the second air-containing portion comprises a second vortex offsetting element for eliminating a vortex caused by air flowing through the second air-containing portion.

17. The fan of claim 16, wherein the second vortex offsetting element is a rib, a plate structure, or a curved structure.

18. The fan of claim 16, wherein the second vortex offsetting element is located at a corner of the second air-containing portion or the second exit of the second air-containing portion.

19. The fan of claim 16, wherein a length between the inner side of the first vortex offsetting element and the outer side of the first vortex offsetting element is different from a length between the inner side of the second vortex offsetting element and the outer side of the second vortex offsetting element.

20. The fan of claim 16, wherein the third blade set and the second vortex offsetting element are horizontally interlaced disposed, and the second vortex offsetting element is extended above a part of the third blade set so that the second vortex offsetting element and the third blade set are overlapped in the horizontal direction in the cross-sectional view of the fan.

* * * * *